US010017364B2

(12) United States Patent
Flateland

(10) Patent No.: US 10,017,364 B2
(45) Date of Patent: Jul. 10, 2018

(54) TRACTION WINCH

(71) Applicant: MacGregor Pusnes AS, Arendal (NO)

(72) Inventor: Kai Ingvald Flateland, Dølemo (NO)

(73) Assignee: MacGregor Norway AS, Kristiansand (NO)

( * ) Notice: Subject to any disclaimer, the term of this patent is extended or adjusted under 35 U.S.C. 154(b) by 532 days.

(21) Appl. No.: 14/766,335

(22) PCT Filed: Feb. 6, 2014

(86) PCT No.: PCT/EP2014/052313
§ 371 (c)(1),
(2) Date: Aug. 6, 2015

(87) PCT Pub. No.: WO2014/122207
PCT Pub. Date: Aug. 14, 2014

(65) Prior Publication Data

US 2015/0375975 A1 Dec. 31, 2015

(30) Foreign Application Priority Data

Feb. 7, 2013 (EP) ..... 13154375

(51) Int. Cl.
*B66D 1/74* (2006.01)
*B66D 1/14* (2006.01)
(Continued)

(52) U.S. Cl.
CPC ..... *B66D 1/7405* (2013.01); *B66D 1/14* (2013.01); *B66D 1/26* (2013.01); *B66D 1/30* (2013.01); *B66D 1/36* (2013.01); *B66D 5/00* (2013.01)

(58) Field of Classification Search
CPC ... B66D 1/14; B66D 1/26; B66D 1/30; B66D 1/7405; B66D 1/741; B66D 5/06; B66D 5/08; B66D 5/26
See application file for complete search history.

(56) References Cited

U.S. PATENT DOCUMENTS 3,934,482 A 1/1976 Byers
3,966,170 A 6/1976 McKenna
(Continued)

FOREIGN PATENT DOCUMENTS

DE 47 478 C 6/1889
FR 1 105 165 A 11/1955
GB 1 387 493 A 3/1975

OTHER PUBLICATIONS

European Search Report dated Aug. 13, 2013, in corresponding EP Application No. 13154375.3 (5 pages).
(Continued)

*Primary Examiner* — Sang K Kim
*Assistant Examiner* — Nathaniel L Adams
(74) *Attorney, Agent, or Firm* — Osha Liang LLP

(57) ABSTRACT

A traction winch for winching an elongated article having a high-tension end connectable to a load and low-tension end connectable to a storage device includes two or more rotatable drums arranged adjacent to each other with their rotational axes substantially parallel, each of them having a plurality of parallel, circumferential sheaves with groove, the sheaves being axially offset with respect to each other to allow wrapping of the elongated article around the sheaves of both drums in a spiral fashion. The sheaves includes fixed sheaves, stationary relative to their underlying drum, and rotatable sheaves, rotatable relative to their underlying drum. The majority of the rotatable sheaves of at least one of the drums is arranged adjacent to each other on a high load supporting side of the winch and the rotational velocity of at least one of the rotatable sheaves is reducible by means of at least one braking device.

16 Claims, 5 Drawing Sheets

Figure 1:
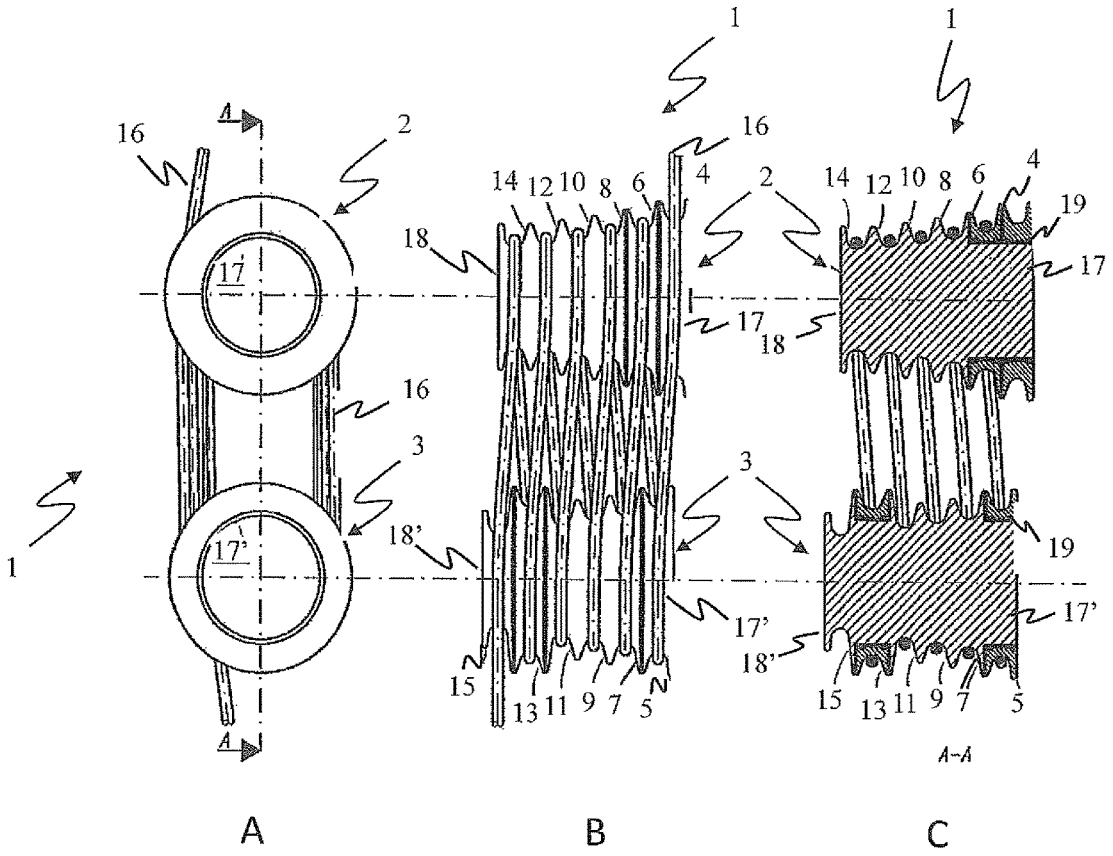

(51) Int. Cl.

| | |
|---|---|
| ***B66D 1/26*** | (2006.01) |
| ***B66D 1/30*** | (2006.01) |
| ***B66D 1/36*** | (2006.01) |
| ***B66D 5/00*** | (2006.01) |

(56) References Cited

U.S. PATENT DOCUMENTS

| | | | | |
|---|---|---|---|---|
| 4,447,044 | A * | 5/1984 | Nakata | B66D 1/44<br>192/17 A |
| 7,175,163 | B2 | 2/2007 | Blanc | |
| 8,322,691 | B2 * | 12/2012 | Boussaton | B66D 1/7405<br>242/364.2 |

OTHER PUBLICATIONS

International Search Report issued in corresponding application No. PCT/EP2014/052313 dated Feb. 26, 2014 (2 pages).

International Preliminary Report on Patentability issued in corresponding application No. PCT/EP2014/052313 dated May 28, 2015 (13 pages).

* cited by examiner

TRACTION WINCH

TECHNICAL FIELD

This invention relates to a traction winch, in particular a double drum traction winch, wherein at least some of the drum's cable supporting pulleys are rotatable.

BACKGROUND OF THE INVENTION

Some present day winch systems for controlling tension on a mooring line employ a pair of parallel traction drums and a storage drum, where the rope coming from the load is passed a multiple times around the pair of traction drums and then guided to the storage drum. The traction drums hold the rope by friction and operate as the principal power for pull-in means or braking means for paying out line, whereas the storage drum upon which the low tension end of the line is spooled, supplies the tension required to maintain the frictional forces between the rope and the traction drums. Maximum holding capacity is thus limited to the friction established between the contacting surfaces of the rope and the sheaves/pulleys on the drum and the tension load supplied on the low load side of the winch. The rope tensioning will be distributed over the axial contacting area of the winch until force equilibrium has been obtained.

However, during pull-in or paying-out of the rope there are other parameters that must be taken into account to maintain optimal yield capacity of the winch.

When the rope enters the winch at high tension, and hence a large degree of stretching, the rope tensioning should ideally be significantly reduced when passing the first two or three sheaves, thereby reducing the degree of stretching. The result is that, per time unit, the amount of rope entering and leaving a sheave is not identical causing a micro-skidding between the rope and the sheave, i.e. skidding that does not cause a net translational movement of the rope relative to the underlying sheave. Hence, given a certain sheave diameter of this initial, micro-skidding sheave and a rope having a certain Young's modulus, there exists an ideal sheave diameter of the subsequent sheave of the winch that sustains an optimum winching capacity.

For example, if the sheave diameter of the subsequent sheave is larger than the ideal sheave diameter, this sheave will require more rope to avoid skidding. Hence, the reduction of the rope tensioning becomes less than the maximum reduction causing the tensioning to propagate further towards the low load side of the winch. Calculated from the low load side it is possible to find a maximum available counter tensioning for each sheave which depends on the applied low side tensioning and the contact surface friction between the sheave and the rope. If this maximum available counter tensioning is not sufficient to balance the tensioning from the high load side of the winch the result will be a continuous skidding of the rope.

On the other hand, if the sheave diameter of the subsequent sheave is smaller than the ideal sheave diameter, this sheave will require less rope to avoid skidding. This is clearly not possible since the reduction of tensioning over the initial sheave cannot be less than the sheave's maximum force transmission capacity. Therefore, the subsequent sheave receives an excess amount of rope, causing a sudden tension reduction. As a consequence there will not be sufficient counter tensioning to balance the load on the high load side of the initial sheave, causing a continuous skidding over the latter. If the mismatch in diameter continues the result would be that the rope is continuously loosing the tensioning towards the low load side of the winch.

Another important challenge occurs during operation of a traction winch at very low loads. In this situation it is not certain that the any skidding will take place on the first sheaves on the high load side. The result may be piling of rope on the winch which again causes the rope to be suspended underneath the drums at one or more turns. Except from being a problem in itself, a rapid change in load could cause skidding over an extensive length at high velocity, thus increasing the risk of damages.

In general, extensive skidding of a rope/cable on a winch must be avoided since skidding causes wear. This is of particular importance at high load.

Hence, in modern traction winches these well known challenges have normally been solved by finding a compromise to ensure that a certain rope/cable having a certain load works in an optimized manner.

The above mentioned challenges are particularly evident when mooring elastic cables such as synthetic ropes under high tension since the level of compensation due to elastic contractions and elongations of the rope as the rope tension diminishes and increases, respectively, while passing through the winch is particularly high.

During the last decades several solutions have been suggested to meet these challenges. An example of publication addressing the challenge of compensating contraction/elongation of ropes is found in FR 1,105,165 disclosing as solution involving decrease in sheave diameter from the high tension side of the drums to the low tension side. Furthermore, U.S. Pat. No. 7,175,163 discloses a winch wherein the sheaves, or at least the part of the sheaves contacting the cable/rope, is made of a product that is sufficiently elastic to follow any changes in the cable length due to high load, while at the same time maintain high friction between the contacting surfaces.

However, a disadvantage of this prior art publication is a poor capacity to quickly and simply adjust to cables having significantly different contraction and elongating properties during operation. One example is the replacement of traditional fibre ropes with relatively high elasticity (common Young's modulus 1-1.4 GPa) with high yield fibre rope such as high yield polyethylene fibre (common Young's modulus: 35-45 GPa), thus reducing the longitudinal stretching significantly at identical loads. In addition, such high yields fibre ropes have much lower frictional coefficients with steel, increasing the possibility of skidding on the underlying sheave/pulley.

U.S. Pat. No. 3,966,170 and GB 1,387,493 discloses a solution involving dissimilar rotation velocity of the drums, resulting in a fairly complex and expensive system.

None of the prior art publications discloses a solution in which the winch may be reconfigured to optimize the suitability for ropes/cables with Young's modulus in both low and high ranges, for example traditional fibre ropes and high yield fibre ropes, respectively.

Object of the Invention

The object of the invention is to find a solution that may handle ropes/cables having a large range of elasticity properties in an easy and inexpensive manner while maintaining a high tensioning capacity.

General Description of the Invention

The above-identified object is achieved by a traction winch in accordance with claim 1 and a method comprising the steps of claim 15. Further beneficial features are defined in the dependent claims. With this arrangement of the traction winch and traction winch assembly the user may reconfigure the winch during operation to ensure optimization of the tensioning capacity required by the specific rope/cable and the specific load.

More specifically, the invention concerns a traction winch for winching an elongated article having a high-tension end connectable to a load and a low-tension end connectable to a storage device. The traction winch comprises two or more rotatable drums arranged adjacent to each other with their rotational axes substantially parallel. Each of said drums has a plurality of parallel, circumferential sheaves with groove, the sheaves being axially offset with respect to each other to allow wrapping of the elongated article around the sheaves of both drums in a spiral fashion. Said plurality of sheaves comprises fixed sheaves being stationary relative to their underlying drum and rotatable sheaves being rotatable relative to their underlying drum. The majority of the rotatable sheaves of at least one of the drums are arranged adjacent to each other on a high load supporting side of the winch, and the rotational velocity of at least one of the rotatable sheaves is, relative to its underlying drum, reducible by means of at least one braking device. Note that "reducible" covers hereinafter rotational velocities ranging from less than the initial velocity to full stop. However, said reduction of the velocity is preferably significant compared to the initial velocity.

In an advantageous embodiment, for each rotatable sheaves the inner radial surface contacting (directly or indirectly) the sheaves' underlying drum is configured to ensure a frictional resistance that is less than the resulting frictional resistance set up between the outer radial surface of the rotatable sheave and the contacting surface of the supporting elongated article during operation.

In another embodiment at least two, and most preferably all, of the rotatable sheaves are rotatable independently of each other.

With reference to the axial end of the high load supporting side, in yet another embodiment at least the first, second and third sheave, and possibly up to the fifth sheave, that receives the elongated article during operation, may be of type rotatable sheaves. Note that the braking device may decelerate (and/or lock) rotatable sheaves by way of inducing a friction increase between the at least one of the rotatable sheaves and the underlying drum, for example by direct pressure, even during operation of the inventive winch. Alternatively, the desired reduction in rotational velocity may be induces by means of one or more physical barriers, or a combination of physical barrier(s) and said induce of friction increase. It is particularly preferred to configure the second sheave to become both rotatable and brakeable/lockable relative to its underlying drum.

With reference to the axial end of the high load supporting side, in yet another embodiment the diameter of at least the first, second and third sheave, and possibly up to the fifth sheave, receiving the elongated article during operation is gradually reduced towards the low load supporting side. Further, the diameter of the majority of the remaining sheaves may be equal, or gradually reduced to a smaller extent compared to the diameter reduction of at least the first, second and third sheave, and possibly up to the fifth sheave, towards the low load supporting side.

With reference to the axial end of the high load supporting side, in yet another embodiment at least one of the sheaves arranged at or near the axial end of the low load supporting side may have a diameter that is equal or approximately equal to the diameter of the first sheave. Furthermore, among the sheaves arranged at or near the low load supporting side, at least the sheave having a diameter equal or approximately equal to the diameter of the first sheave may be rotatable. Note that the expression "at or near the low load supporting side" signifies less than 20% of the axial length of the drum relative to its axial edge. The at least one rotatable sheave having a diameter equal or approximately equal to the diameter of the first sheave may also be brakeable by means of at least one braking device.

In yet another embodiment the traction winch may further include biasing means comprising at least one roller, means for moving said at least one roller into engagement with the elongated article on the low load side of the winch during operation and means for maintaining said at least one roller into engagement with the elongated article during operation such that a predetermined back tension is ensured on the elongated article.

In yet another embodiment the traction winch may further include drive means for rotating the drums, the drive means comprising a common shaft in gripping arrangement with both drums and a motor for transmitting a rotational force to the common shaft. Said gripping arrangement may preferably be enabled by gear wheels situated on the drums In addition to the inventive traction winch, the invention also includes a method for hoisting an elongated article onto a traction winch in accordance having any of the characteristics mentioned above. The method comprises the following steps:

- guiding the elongated article in a spiral fashion along the sheaves of the traction winch,
- decelerating the rotational velocity of one of at least first, second and third rotatable sheave, and possibly up to the fifth sheave, to its underlying drum by at least one of the at least one braking device in the case of hoisting an elongated article with a Young's modulus less than 10 GPa and preferably a load on the high-tension end of the elongated article higher than 20 metric tons, and
- releasing or keeping released the at least one braking device applied to one of the at least first, second and third rotatable sheave, up to the fifth sheave, in the case of hoisting an elongated article with a Young's modulus higher than, or equal to, 10 GPa and preferably a load on the high-tension end of the elongated article higher than 20 metric tons.

In a more preferred embodiment the method comprises the following steps:

- guiding the elongated article in a spiral fashion along the sheaves of the traction winch,
- locking one of at least first, second and third rotatable sheave, and possibly up to the fifth sheave, to its underlying drum by at least one of the at least one braking device in the case of hoisting an elongated article with a Young's modulus less than 10 GPa and preferably a load on the high-tension end of the elongated article higher than 20 metric tons, and
- unlocking or keeping unlocked one of the at least first, second and third rotatable sheave, up to the fifth sheave, from its underlying drum in the case of hoisting an elongated article with a Young's modulus higher than, or equal to, 10 GPa.

The first step of either methods may be performed either before or after any reconfiguration of the traction winch.

Typical operation intervals of the Young's modulus and the load during the second step are less than 3 GPa and more than 45 metric tons. Similarly, typical operation intervals for the third (last) step are more than 35 GPa and more than 45 metric tons.

In the following description, numerous specific details are introduced to provide a thorough understanding of, and enabling description for, embodiments of the claimed apparatus. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

SHORT SUMMARY OF THE DRAWINGS

Figure 2A:
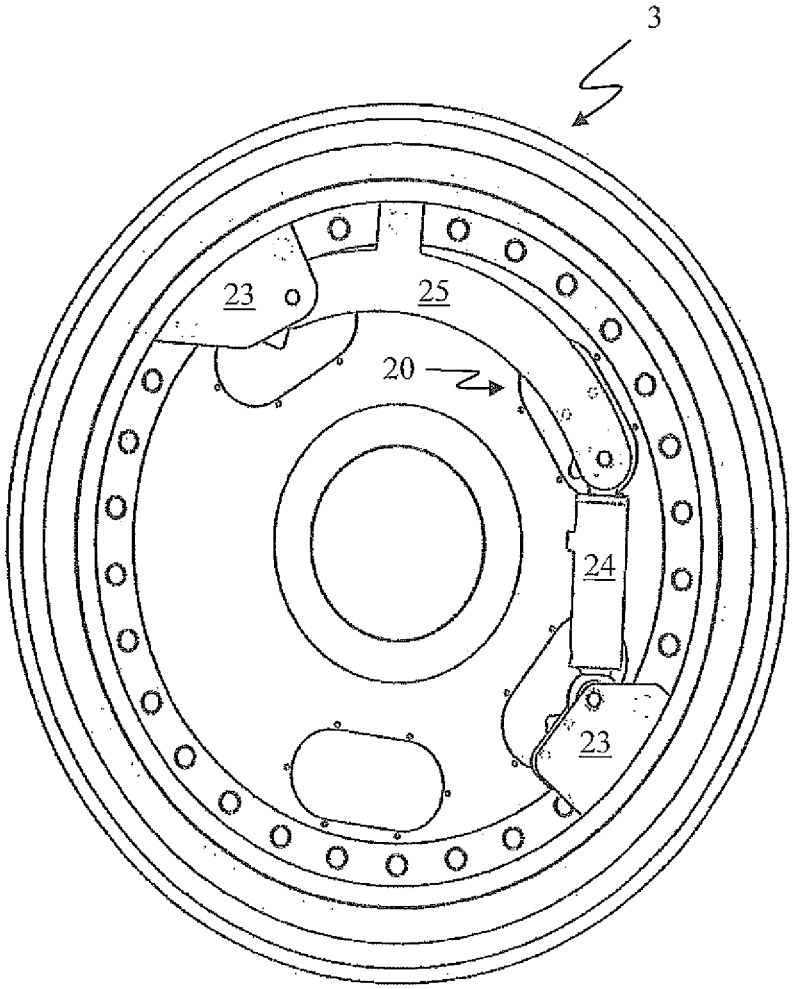
Figure 2B:
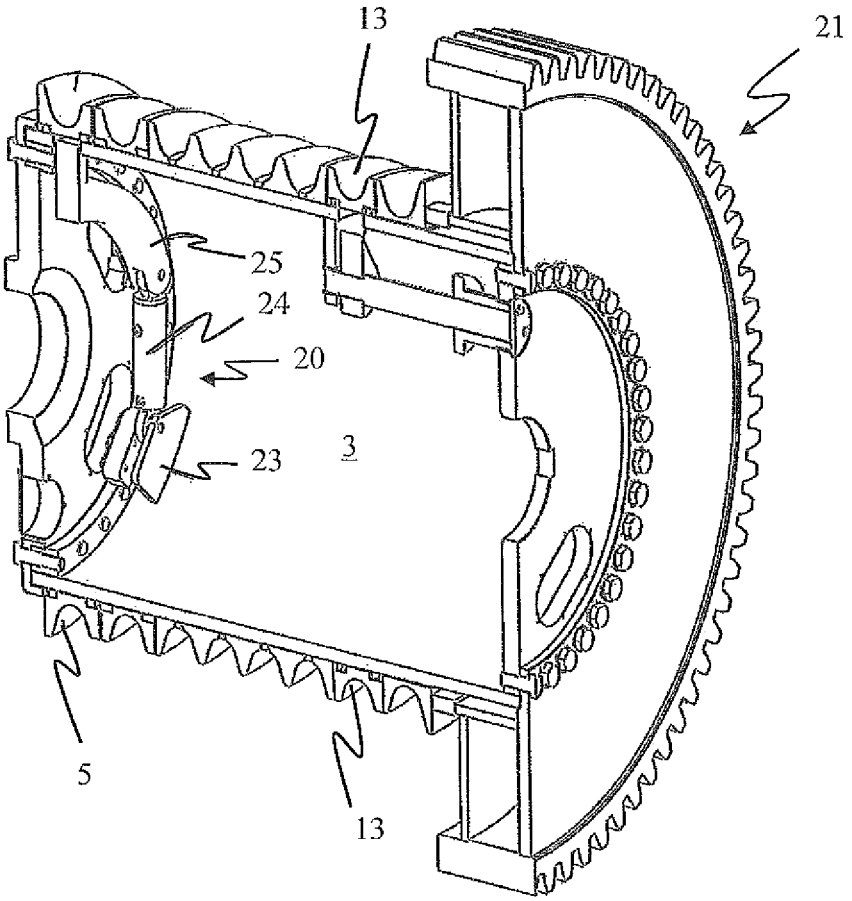
Figure 3:
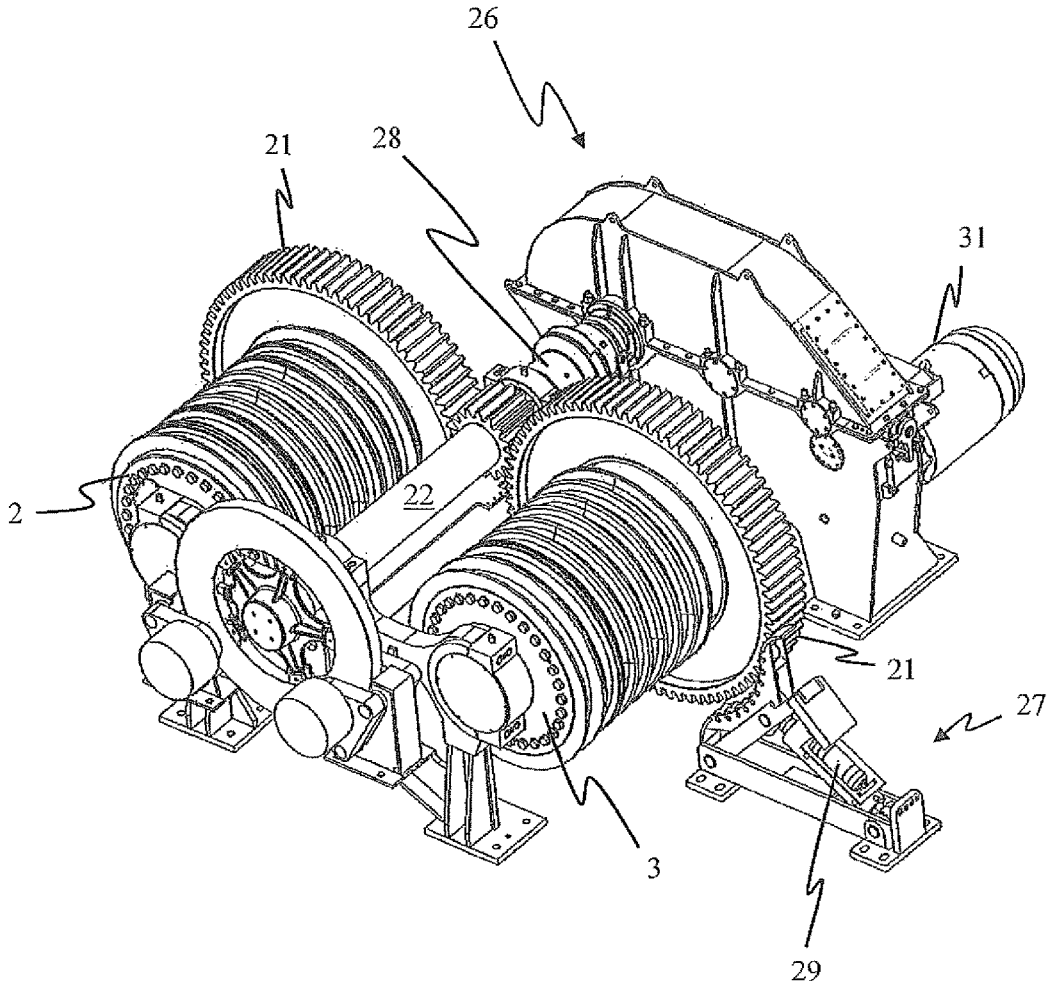
Figure 4:
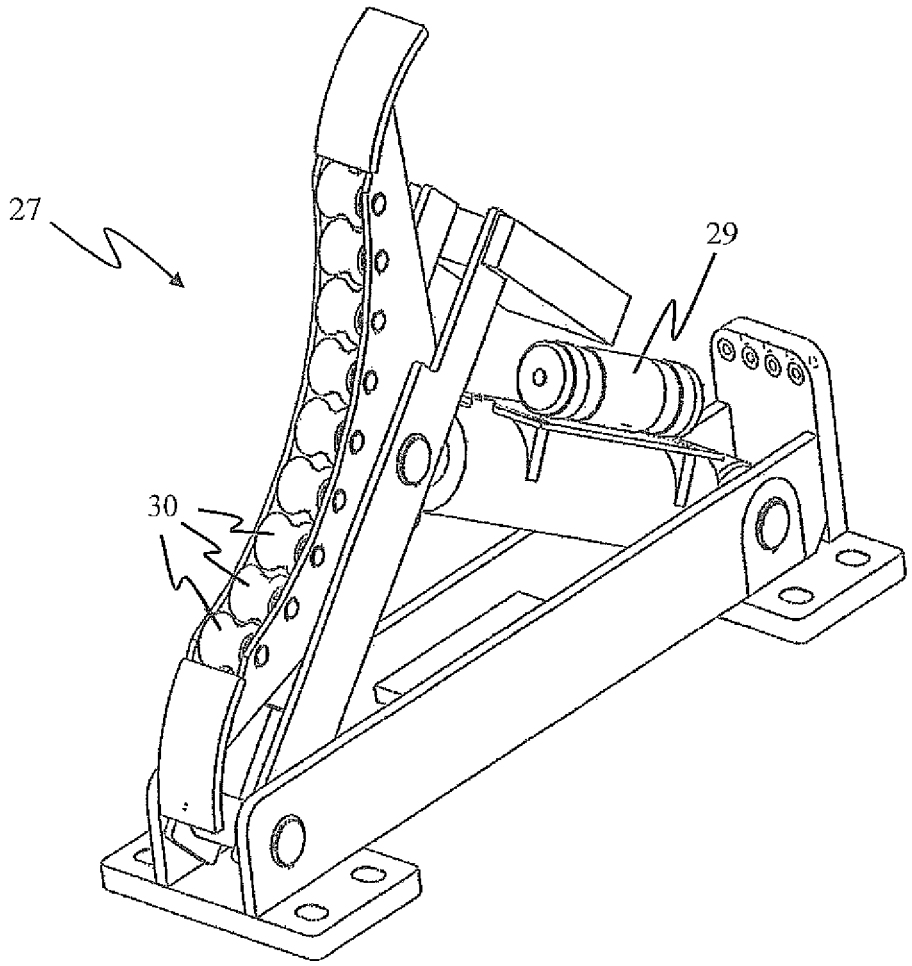

Preferred embodiments of the present invention will now be described with reference to the attached drawings, in which:

FIGS. 1A-C is schematic illustrations of a traction winch in accordance with the invention comprising two drums with a rope extending from the winch's high load side to the winch's low load side, FIGS. 2A-B is schematic illustrations of one drum in the traction winch according to FIG. 1, viewed perpendicular to the axial axis of the drum (A) and in a perspective view of the drum (B), FIG. 3 is a perspective view of a traction winch assembly in accordance with the invention comprising the traction winch, a drive means and a tension device, and FIG. 4 is a perspective view of the tension device illustrated in FIG. 3.

DETAILED DESCRIPTION OF THE INVENTION

FIG. 1 shows a schematic view of an inventive traction winch 1 comprising a first rotatable traction drum 2 and a second rotatable traction drum 3, wherein the first and second traction drums 2,3 are arranged in an axially parallel manner. Around the axial circumference of each traction drums 2,3 there are arranged a multiple number of sheaves or pulleys 4-15, where each of the sheaves 4-15 has a groove being complemental with a cable or rope 16. Note that a sheave should be interpreted as both a separate disc (as is the case for sheaves 4-6 and 13 in FIG. 1) or a disc being a partly or fully integral part of an object (as is the case for sheaves 7-12 and 14-15 in FIG. 1). The rope 16 is in FIG. 1 seen to perform a multiple number of wraps of the rope 16 over the grooves of the traction drums 2,3 in an axial side-by-side relation, with the end of the rope 16 exiting the sheave 15 on the second drum 3 axially opposite of the sheave 4 onto which it entered the first drum 2. When the rope 16 enters the first drum 2 on the high load side 17, that is, the side intended to pull-in or lower the load in question, it bends around part of a first rotatable sheave 4 of the first drum 17. In this embodiment the first rotatable sheave 4 acts primarily as a guide disk since its rotation/bending normally is equal or less than 90 degrees, depending on the particular arrangement. After having passed the first sheave 4 with the desired bending the rope 16 continuous its course to a second sheave 5 situated, as the first sheave 4, on the high load side 17' of the second drum 3, and then continues to a third sheave 6 situated at the first drum 2 adjacent to the first sheave 4. This arrangement is repeated until the rope 16 exits the traction winch on a last sheave 15 situated on the low load side 18'. In this embodiment the last sheave 15 is the (axial) end sheave on the second drum 3.

As mentioned above, almost all the force transmission capacity between the rope 16 and the groove in the second sheave 5 shall ideally be applied to lower the tensioning of the rope 16 so that an insignificant amount of tensioning remains when the wrapping of the rope 16 continues to the third sheave 6. When the tensioning is reduced, the elongation of the rope 16 is reduced correspondingly, resulting in that the amount of rope 16 per time unit which enters the second sheave 5 is larger than the amount of rope 16 per time unit which leaves the same sheave 5.

The first sheave 4 is acting primarily as a guide disk for the rope 16. The sheave diameter is preferably larger than any of the other sheaves 5-15 in order to ensure that the rope 16 is not skidding on the first sheave 4. Such a skidding would increase the tensioning transmitted to the subsequent second sheave 5. A larger sheave diameter also increases the contact surface between the rope 16 and the sheave's groove, thereby contributing to a tensioning reduction. The ratio of the sheave diameters between the first sheave 4 and the second sheave 5 is chosen in order that as much as possible of the load capacity entering the first sheave 4 is exploited. Such an optimization is particularly important when ropes with low Young's modulus are winched.

The main task of the second sheave 5 is to quickly reduce the rope tensioning, especially when ropes having low Young's modulus enters the winch 1, i.e. ropes exhibiting a relatively large elongation when subjected to a load. This second sheave 5 is configured to slide on the underlying second drum 3, for example via one or more journal bearings 19. The size of the contact surfaces between the shown bearing(s) 19 and the second drum 3, as well as the bearing material's overall friction coefficient towards its underlying drum surface, are selected to ensure that the overall bearing's frictional resistance remains smaller than the resulting gliding resistance established by the overall frictional coefficient between the groove surface of the second sheave 5 and the rope 16. If this has not been the case, an undesired gliding of the rope 16 relative to the second sheave's groove would have started prior to any rotation of the sheave 5. The ratio between the two gliding resistances is normally independent of any variations in the load. The arrangement allows transmission of the force from the second drum 3 to the rope 16 without risking significant skidding of the rope 16, an effect which is of particular importance at the high load side 17,17' of the winch 1 in which the load is relatively high compared to the low load side 18,18', and where the risk for damages on the rope 16 itself and its surroundings are highest. In addition to being rotational, the second (rotational) sheave 5 is also distinctive in including a first braking device 20 that may brake, or even lock, the sheave 5 relative to its underlying second drum 3 when appropriate, thereby effectively reconfiguring the traction winch 1 during or outside operation. This first braking device 20 brakes or locks the sheave by for example exerting a pressure towards the underside of the rotatable sheave 5, which pressure being sufficient to stop or at least significantly reduce the rotational velocity of the sheave. The pressure may be enforced by any known means, for example by use of a hydraulic cylinder. Note that the number of sheaves in FIG. 1 and FIGS. 2A-B is not equal.

The subsequent third sheave 6 arranged on the first drum 2 is preferably also supported on one or more journal bearings 19 in the same way as for the second sheave 5 allowing the third sheave 6 to perform axial rotations relative to the underling first drum 2. It may also be provided with a second braking device (not shown), or alternatively apply the first braking device 20, in order to brake or lock the sheave 6 relative to the first drum 2. As for the relation between the sheave diameters of the first 4 and second 5 sheaves the third sheave 6 has preferably a diameter that is smaller than the diameter of the second sheave 5 in order to ensure that most of the load capacity entering the first sheave 4 is exploited, in particular when ropes with low Young's modulus is winched.

Even if the first sheave 4 is acting primarily as a guide disk it may also be provided with one or more journal bearings 19 slidable on the first drum 2, thereby contributing in transmitting force between the first drum 2 and the contacting surface of the rope 16. If the first sheave 4 is rotatable its bearing(s) 19 are preferably constructed in accordance with the same principles as for the above disclosed bearings.

At low loads any significant reduction in sheave diameters is not strictly necessary with when going from the high load side 17,17' towards the low load side 18,18', even during winching of ropes having low Young's modulus. In this case the geometry of the diameter reduction from first 4 to second, third (or higher order) sheaves is too big compared to the ideal diameter reduction. This non-ideal configuration results in a continuous skidding in order to equalize the amount of rope per time unit entering and exiting these particular sheaves 4,5,6. However, such skidding is not considered to be of any major significance since it takes place between the contacting surfaces of the journal bearings 19 and their underlying drums 2,3. Furthermore, any excessive heating at these contacting surfaces are not likely since the velocity would be relatively low. However, if this scenario turns out to be incorrect, arranging a suitable cooling system may be advisable. In any case, the desired geometry of the sheaves 4-15 is that which contribute to the highest load reduction of the rope when guided from sheave to sheave.

In FIG. 1 the drum integrated sheaves 7-12 and 14-15 succeeding the third sheave 6 towards the low load side 18,18 of the winch 1 are illustrated as non-rotational sheaves, which grooves of the integrated sheaves are designed similar to the grooves in the first to third sheaves 4-6, i.e. adapted for receiving the rope 16 to be winched. However, one or more of these low load sheaves 7-12,14-15 may be replaced with rotatable sheaves in the same way as for the first three sheaves 4-6 if this is found appropriate, possibly with their respective or common braking device(s) (not shown). In either ways the principles remain the same. In general, for a given drum diameter an increase in the number of sheaves in a winch 1 results in an increase in the total load capacity. For the sake of simplicity these non-rotational, drum integrated sheaves or rotational sheaves arranged on the low load side 18,18' of the third rotational sheave 6 will be referred to as fixed low load sheaves 7-12,14-15. Likewise, the rotational first to third sheaves 4-6 will be referred to as rotational high load sheaves.

At least some of the low load sheaves 7-12,14-15 have preferably a gradual diameter reduction that is adapted for a rope with high Young's modulus. The reason for this is two-fold:

- due to the particular configuration of at least some of the rotational sheaves 4-6 on the high load side 17,17', for example by the second sheave 5, a significant part of the rope tensioning has already been removed when the first low load sheaves 7 is reached, and
- the primarily function of the inventive winch 1 is to perform winching of high yield polyethylene ropes having a stiffness (around 35-45 GPa) that is significantly higher than for example a traditional polypropylene hawser (1-1.4 GPa), thus requiring less elongation/contraction compensation.

When a rope with low Young's modulus is winched onto or out of the traction winch 1, and the sheave rotation reaches a predetermined value, the second sheave 5 (and alternatively one or more of the other sheaves equipped with a braking device 20) is decelerated or locked relative to the underlying drum 3. If this takes place, and if the diameter down-scaling between the rotatable high load sheaves 4-6, for example the first and second sheaves 4,5, the second and third sheaves 5,6 and the third 6 and first 7 of the low load sheaves 7-12,14-15, are adapted to a rope 16 with low Young's modulus, the capacity of the winch 1 to transmit force between the sheaves 4-15 and the rope 16 is exploited in a more optimum manner, causing a more rapid reduction in tensioning. The tensioning of the rope 16 entering the fixed low load sheaves 7-12,14-15 exhibiting the above mentioned high Young's modulus diameter scale-down will be higher than the optimum tensioning. This would result in a point of equilibrium somewhere at the low load side 18,18' of the drums 2,3, causing a continuous gliding between the sheaves and the drums at the low load side of this point. However, this is not considered critical since the load is low compared to the high load side of the winch 1.

In the other hand, when a rope with high Young's modulus is winched onto or out of the traction winch 1, the diameter scale-down of the rotatable high load sheaves 4-6 would be larger than the ideal diameter scale-down. This scale-down misfit is almost independent of the load on the rope. The result is a continuous, or almost continuous, skidding in order to compensate the excessive amount of rope per time unit fed to the subsequent sheave. Again, such skidding is considered quite harmless since it occurs at relatively low velocities between the contacting surfaces of the journal bearings 19 and the underlying drum 2,3. But in certain situations it may be advantageous to install an appropriate cooling system on the winch 1 to dissipate any frictional heat that may arise. In the situation with rope having high Young's modulus all of the high load sheaves 4-6 may be allowed to rotate, i.e. with the braking device(s) 20 disengaged. The diameter scale-down of the fixed low load side sheaves 7-12,14-15 is chosen based on the Young's modulus of the rope and a given normal load. The latter would necessarily be a compromise, but as emphasized above, the rope 16 winded around the rotatable high load sheaves 4-6 are well protected from wear since most or all of the skidding takes place between the contacting surface of the journal bearings 19 and the underlying drum 2,3. And since the Young's modulus is high there will be very little tensioning variations, causing skidding with relatively low velocities between the rope 16 and the fixed sheaves 7-12, 14-15.

Irrespective of the Young's modulus of the rope 16 the winching onto a traction winch 1 faces a challenge when operating ropes of long length at low loads (slack rope heave) since there would be a significant risk of rope congestion on the winch 1 caused by the significantly larger sheaves encountered by the rope prior to entering the grooves of a cooperative storage winch (not shown). This problem is well known, and earlier attempts to find working solutions have been to replace the last sheave on the low load side of the winch 1 with a sheave having a diameter similar to the diameter of the first high load sheave 4, commonly referred to as a slack rope heave sheave/groove. The purpose of this particular arrangement is to ensure that the end low load sheave receiving the rope from the storage winch is capable of guiding the rope through the traction winch 1 with a velocity that prevents the above mentioned rope congestion further towards the high load side. However, the problem with this prior art solution is that a continuous skidding of the slack rope heave sheave will take place at high velocity when the load is increased. Furthermore, this sheave/groove will increase the risk for unfavourable skidding, thus reducing the force transmission capacity during winching of ropes as explained above. In order to overcome this problem it is considered advantageous to let one of the last sheaves 13 on the high load side 18,18' of one of the drums 2,3 to be both rotational/skidable and brakeable/lockable in the same manner as explained for the high load side sheaves 4-6. When a slack rope heave operation is performed this slack rope heave sheave 13 is kept locked (or with reduced rotational velocity) until a certain predetermined minimum limit of the load is reached, and thereby to obtain the same advantageous as the prior art solution. This limit may of course vary for ropes with low and high Young's modulus. However, above this limit, for example during rope lowering, the slack rope heave sheave 13 is kept rotatable. In this way the skidding is moved from the contact surfaces between the rope 16 and the sheave grooves 4-15 to the contact surfaces between the journal bearings 19 and the underlying drum 2,3.

FIGS. 2 A and B shows the arrangement of a braking device 20 in accordance with the invention, viewed along the drums axial axis and in perspective, respectively. FIG. 2 B also shows a drum gear wheel 21 situated around at the edge of the drums low load side in order to allow a gripping engagement with a rotating shaft 22 as seen in FIG. 3 and explained in further detailed below. In the embodiment shown in FIGS. 2 A and B the braking device 20 comprises one or more pads 23 kept in pressurized contact with the relevant rotating sheave 4-6,13 a braking device hydraulic cylinder 24 allowing control of the pad pressure toward the relevant rotating sheave 4-6,13 and a fixed coupling 25 coupling the pad(s) 23 and the hydraulic cylinder 23 to the drum 2,3. The locking and unlocking (or alternatively braking and releasing) by the braking device 20 is thus achieved by operating the hydraulic cylinder 23, either by direct intervention by a user or by an automated process.

FIG. 3 shows a traction winch assembly which, in addition to the traction winch explained above, also includes a drive means 26 and a tension device 27 in accordance with the invention. The drive means 26 further comprises a common gear shaft 28 in gear transmission with corresponding gear wheels 21 arranged on an axial end of both drums 2,3, thereby providing an equal rotational drum velocity when measured from each drums axial center. FIG. 3 also shows a tension device or biasing means 27 situated at the low load side of the drum 3 to provide an increase in the traction winch load capacity. The latter depends on the frictional resistance between the rope 16 and the sheaves' grooves, as well as the ropes 16 rotational angle per sheave, the number of sheaves and the tension exerted on the low load side of the winch. By increasing the tension on the low load side the tension of the winch and its braking capacity may be increased significantly. During operation the tension device 27 exerts thus a pressure on the part of the rope 16 situated in the groove of one of the low load side sheaves. The pressure can be set up by for example use of a tension device hydraulic cylinder 29. As for the braking device 27, the tension device hydraulic cylinder 29 may be operated either by direct intervention by a user or by an automated process. In FIG. 4 the tension device 27 is shown with rope contacting parts in form of a plurality of rollers 30 forming a curvature adapted to the overall curvature of the corresponding contacting area of the winch.

The invention claimed is:

1. A traction winch for winching an elongated article having a high-tension end connectable to a load and a low-tension end connectable to a storage device, the traction winch comprising:

two or more rotatable drums arranged adjacent to each other with rotational axes of the two or more rotatable drums substantially parallel, wherein each of the two or more rotatable drums have a plurality of parallel, circumferential sheaves with a groove, the sheaves being axially offset with respect to each other to allow wrapping of the elongated article around the sheaves of both drums in a spiral fashion, wherein the plurality of sheaves comprises:

fixed sheaves that are stationary relative to one of the two or more rotatable drums; and rotatable sheaves that are rotatable relative to one of the two or more rotatable drums, wherein a majority of the rotatable sheaves of at least one of the the two or more rotatable drums are arranged adjacent to each other on the high-tension end of the traction winch, wherein a rotational velocity of at least one of the rotatable sheaves is reducible by means of at least one braking device, and wherein the at least one braking device brakes the at least one of the rotatable sheaves by exerting a pressure towards the underside of the at least one of the rotatable sheaves, the pressure being sufficient to reduce the rotational velocity of the at least one of the rotational sheaves.

2. The traction winch according to claim 1, wherein, for each of the rotatable sheaves, an inner surface of each of the rotatable sheaves that contacts one of the two or more rotatable drums is configured to ensure a frictional resistance being less than a resulting frictional resistance set up between an outer surface of each of the rotatable sheaves and a contacting surface of the elongated article during operation.

3. The traction winch according to claim 1, wherein at least two of the rotatable sheaves are rotatable independently of each other.

4. The traction winch according to claim 1, wherein at least one of the rotatable sheaves is lockable to one of the two or more rotatable drums by means of at least one of the at least one braking device.

5. The traction winch according to claim 1, wherein any reduction in rotational velocity results from induced friction increase between the at least one of the rotatable sheaves and one of the two or more rotatable drums.

6. The traction winch according to claim 1, wherein, with reference to the high-tension end, a rotational velocity of a second rotatable sheave receiving the elongated article (16) during operation is reducible relative to one of the two or more rotatable drums by means of at least one of the at least one braking device.

7. The traction winch according to claim 1, wherein, with reference to the high-tension end, a diameter of at least a first rotatable sheave, a second rotatable sheave, a third rotatable sheave, a fourth rotatable sheave, and a fifth rotatable sheave receiving the elongated article during operation is gradually reduced towards the low-tension end.

8. The traction winch according to claim 7, wherein a diameter of a majority of remaining rotatable sheaves are equal, or gradually reduced to a smaller extent compared to the diameter reduction of at least the first, second and third sheave (4-6), up to the fifth sheave (8), towards the low load supporting side.

9. The traction winch according to claim 1, wherein, with reference to the high-tension end, at least one of the sheaves arranged at or near the low-tension end has a diameter that is equal or approximately equal to a diameter of a first sheave.

10. The traction winch according to claim 9, wherein among the sheaves arranged at or near the low-tension end, the at least one of the sheaves having the diameter equal or approximately equal to the diameter of the first sheave is rotatable.

11. The traction winch according to claim 10, wherein the rotational velocity of the at least one rotatable sheave having a diameter equal or approximately equal to the diameter of the first sheave is reducible relative to one of the two or more rotatable drums by means of at least one of the at least one braking device.

12. The traction winch according to claim 1, wherein the traction winch further includes biasing means, the biasing means comprising:

at least one roller, means for moving the at least one roller into engagement with the elongated article on the low-tension end of the winch during operation, and means for maintaining the at least one roller into engagement with the elongated article during operation such that a predetermined back tension is ensured on the elongated article.

13. The traction winch according to claim 1, wherein the traction winch further includes drive means for rotating the two or more rotatable drums, the drive means comprising:

a common shaft in gripping arrangement with the two or more rotatable drums; and a motor for transmitting a rotational force to the common shaft.

14. The traction winch according to claim 1, wherein the gripping arrangement is enabled by gear wheels situated on the two or more rotatable drums.

15. A method for hoisting an elongated article onto a traction winch, the method comprising:

providing a traction winch according to claim 1;

guiding the elongated article in a spiral fashion along the sheaves of the traction winch;

with reference to an axial end, decelerating the rotational velocity of one of at least a first rotatable sheave, a second rotatable sheave, a third rotatable sheave, a fourth rotatable sheave, and a fifth rotatable sheave, to one of the two or more rotatable drums by at least one of the at least one braking device in the case of hoisting an elongated article with a Young's modulus less than 10 GPa; and releasing or keeping released the at least one braking device applied to at least one of the first rotatable sheave, the second rotatable sheave, the third rotatable sheave, the fourth rotatable sheave, and the fifth rotatable sheave, in the case of hoisting an elongated article with a Young's modulus higher than, or equal to, 10 GPa.

16. The traction winch according to claim 1, wherein the at least one braking device reduces rotational velocity of the rotatable sheaves by at least:

inducing friction increase between at least one of the rotatable sheaves and one of the two or more rotatable drums by direct pressure.

* * * * *